United States Patent [19]

Courdille

[11] 4,321,449

[45] Mar. 23, 1982

[54] APPARATUS FOR INDUCTION HEATING OF METAL PRODUCTS, PARTICULARLY SLABS AND BLOOMS

[76] Inventor: René Courdille, 9, rue Guy de la Brosse, 75005 Paris, France

[21] Appl. No.: 103,852

[22] Filed: Dec. 14, 1979

[30] Foreign Application Priority Data

Dec. 22, 1978 [FR] France ..... 78 36230

[51] Int. Cl.[3] ..... H05B 5/02

[52] U.S. Cl. ..... 219/10.71; 219/10.61 R; 219/10.69; 266/104

[58] Field of Search ..... 266/129, 104; 148/154; 219/10.75, 10.77, 10.71, 10.69, 10.61 R

[56] References Cited

U.S. PATENT DOCUMENTS 4,124,415 11/1978 Sporenberg et al. ..... 148/154

FOREIGN PATENT DOCUMENTS 1176773 8/1964 Fed. Rep. of Germany .
2328170 5/1977 France .
2339316 8/1977 France .
1513241 6/1978 United Kingdom .

*Primary Examiner*—R. Dean
*Attorney, Agent, or Firm*—John T. Synnestvedt; Albert L. Free

[57] ABSTRACT

An apparatus for heating blooms or slabs comprises a tunnel with a conveyor for supporting successive slabs and moving them along the length of the tunnel. The blooms rest flat on the conveyor rather than on edge. Polyphased inductors are located above and under the path of the bloom to create a travelling wave magnetic field along the tunnel.

10 Claims, 3 Drawing Figures

APPARATUS FOR INDUCTION HEATING OF METAL PRODUCTS, PARTICULARLY SLABS AND BLOOMS

BACKGROUND AND SUMMARY OF THE INVENTION

The present invention relates to induction heating of metal products having a cross-sectional area which is relatively small as compared to their length.

Induction heating apparatuses have been provided in which metal products travel through successive inductor coils belonging to separate heaters and are supported by means, generally rollers, placed between the heaters. That approach is not satisfactory when the products are flat and of great width, such as blooms. Such products need be supported at locations whose longitudinal spacing is small and further decreases as the metal is heated to a higher temperature. The space available for the inductors between two successive supports is small and the space which would be taken up by the rollers, because of their number and their diameter, would increase excessively the length of the furnace.

In another prior art apparatus, the blooms are moved from one furnace to the next by trolleys provided with lifting fingers. The fingers support the blooms placed on edge. The trolley comes under a first furnace into which the fingers lift the bloom. Once the bloom has been heated, the fingers take it down again, the trolley moves under a second furnace into which the fingers introduce the bloom, and so on. Such a procedure has numerous disadvantages: it is not continuous; the blooms must be rotated by 90° since they are delivered flat by the rolling mill; it does not use the whole of the possibilities offered by induction heating; handling is complex; the hot blooms travel in free air and their surface becomes oxidized; the apparatus is not practical for blooms of very great length or comprising edges which are not strictly flat and at right angles to the larger faces.

It is an object of the invention to provide an improved apparatus for induction heating of flat metal products of large size; it is a more particular object to provide an apparatus which is continuous in operation, avoids movement of the products in free air between two heating operations, accepts blooms of very great widths and allows the blooms to be supported at very close intervals, whereby they retain a favorable rectilinear shape.

In general, the invention contemplates an apparatus for heating flat long metal products such as flats, slabs and blooms, comprising means for supporting said products and advancing them along the tunnel, typically in the direction of the great length of the products, said products resting flat on said means on one of the larger surfaces thereof; electrical means for heating the products by induction which comprise at least two flat inductors (typically multiphase inductors creating a sliding field moving in the longitudinal direction of the tunnel) placed one above the path of travel of the product and one under that path. The supporting and advancing means will typically project through the lower inductor.

The inductors may be designed for varying the amount of heat delivered in the product as it moves along the path of travel. For example, it may be desirable to dissipate high power in the initial part of the furnace, in order to bring the product rapidly to a required temperature. In the downstream part, a lower power may be sufficient to maintain the temperature. It will be generally advantageous to split up the furnace, in the direction of its length, into several sections provided with separate temperature regulating means for possible adjustment of the powers in those fractions of the inductors which are located in the successive sections. The temperature rise curves may be adapted to the different grades of metal to be treated and create, if necessary, a final zone of homogenization. Access to the furnace can be retained through the lateral walls of the tunnel, since there are no electrical conductors at that location.

The support and advancing means may be so called "pilgrim step" conveyor supporting the products by means of fingers projecting through the lower inductor. These fingers are connected to a mechanism which is below the inductor located close to the product to be heated.

The supporting and advancing means may also be in the form of disks projecting through the lower inductor and fixed on shafts located outside the tunnel.

SHORT DESCRIPTION OF THE DRAWINGS

Figure 2:
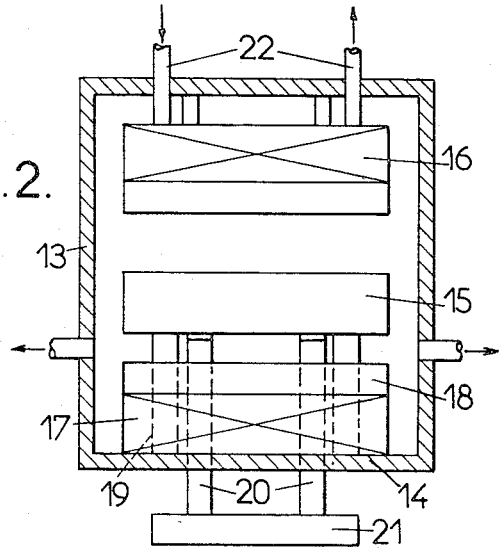
FIG. 2 is a schematic cross-section along line II—II of FIG. 1.
Figure 3:
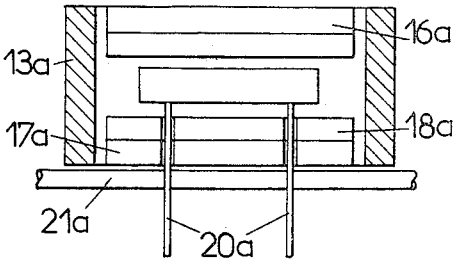

FIG. 3, similar to FIG. 2, shows a modified embodiment.

DETAILED DESCRIPTION OF PREFERRED EMBODIMENTS

Figure 1:
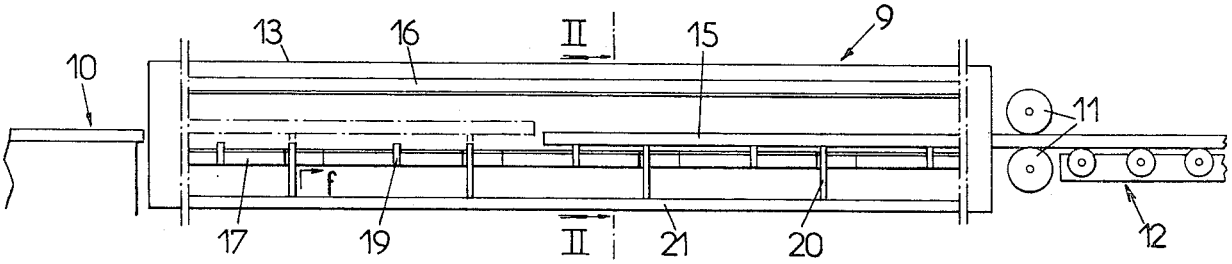
FIG. 1 is a simplified diagram of an apparatus according to an embodiment of the invention, in longitudinal cross-section.

Referring to FIGS. 1 and 2 (where the scale has not been respected for clarity) there is shown an apparatus for induction heating of blooms. Part only of the furnace is shown in FIG. 1. It is associated with a feed table 10 and a discharge table 12 with rollers on which the blooms are brought by pinching rollers 11. Several furnaces may be located side by side with discharge tables 12 of all furnaces feeding the same trolley for distribution to rolling mills, said trolley travelling on tracks transverse to the furnaces.

The furnace 9 typically comprises a tunnel casing 13 which limits heat losses. The lower part of casing 13 may form a floor 14. As shown in FIG. 1, casing 13 contains two polyphase inductors 16 and 17 for supplying electrical travelling fields moving in the longitudinal direction of the furnace. The lower inductor 17 is supported by floor 14. It is located below the path of blooms 15. It is protected from the heat radiated by the blooms by an insulating lagging 18, for example refractory bricks. Inductor 16 may be suspended from the casing or supported by brace rods passing therethrough. It may be similar to inductor 17 in construction. The suspension brace rods are typically supported by a mechanism for adjusting the height of inductor 16 so as to give an optimum value to the gap between inductor 16 and product 15.

The furnace is provided with means for supporting and advancing the blooms 15. In the embodiment illustrated in FIGS. 1 and 2, the means are a "pilgrim step" conveyor of conventional construction. This conveyor comprises stationary supporting feet 19 supported by floor 14 and distributed longitudinally at sufficiently close intervals to avoid bending of the blooms. It also comprises movable feet 20 carried by a longitudinal beam 21 placed under the casing 13. A mechanism, not shown, imparts the motion indicated by arrow f in FIG. 1 to the movable feet and then a return movement. During their forward movement, the movable feet 20 move the bloom forward by one predetermined step. During their return movement (downwardly, then rearwardly), they come back to their original condition.

Since feet 20 and 19 are in contact with the high temperature products, they must be formed from an appropriate material. In practice, materials at least in part non magnetic will be advantageously used in the portion of the furnace where the temperature does not reach the Curie point. It will often be advisable to form these feet (or at least the part thereof in contact with the products 15) from a refractory material throughout the length of the furnace.

When the products to be treated are current metallurgical products whose width scarcely exceeds two meters, two longitudinal lines of feet 20 spaced for example 1 meter apart, are sufficient. Since the resistance to bending and creep of metallurgical products decreases when their temperature increases, it will often be advisable to reduce the gap between two successive feet in the hottest zones of the furnace: a spacing of several meters may be used for example in the entry zone of the furnace where the metal is at a moderate temperature and to select a distance of about one meter in the hottest zones.

Despite the heat insulation of inductors 16 and 17, it will often be necessary to cool them. For that, the upper inductor 16 may for example be provided with a network of tubes for circulating a coolant which is delivered through the casing and removed through conduits 22. Blowers may be provided for removing hot air above the inductor at time intervals. That air flow may simultaneously remove the possible carbon deposits. The tunnel casing 13 will usually be made from sheet metal with an internal lining of refractory material. It may be designed to form an enclosure sufficiently airtight for maintaining in the furnace the conditioning atmosphere which is required for the treatment of some special steels.

Supporting devices other than the pilgrim step conveyor shown in FIGS. 1 and 2 may be used. In the modified embodiment shown in FIG. 3 (where the parts corresponding to those of FIGS. 1 and 2 bear the same reference numerals to which the index a has been added), the supporting means are formed by two rows of disks 20*a*. The upper parts of the disks project through the lower inductor 17*a*. The disks 20*a* are fixed in pairs on drive shafts 21*a* placed below the tunnel and consequently not subjected to heating by the high temperatures which prevail in the furnace.

The drive mechanisms of the shafts may be provided to give to the disks a reciprocal motion of small amplitude if and when rolling is stopped and the products should remain in place, so as to avoid distortion of the products. The control mechanisms of those rollers 20*a* which are located in the end part of the furnace are advantageously provided for high speed delivery of the products, after heating; then, the pinching rollers 11 or the other mechanisms required in most cases for extraction may be omitted.

The advantages of the installation appear immediately: the whole length of the furnace is used, and that length can be reduced; the products are permanently carried flat; the thermal efficiency may be very high, since adjustment is possible, while it is not in coil inductor induction furnaces; the heating curves may be adapted to the different grades of metal to be treated.

By way of example, three apparatuses of the kind defined above are sufficient for supplying with blooms 15 m long, having a cross-section of 250×1500 mm, to a set of continuous band rolling mills producing 6,000,000 tons per year. Each of the three apparatus requires an electric power of about 100 MW. For blooms of current thickness, about 250 mm, the inductors may be supplied at the frequency of the public distribution network, i.e. 50 Hz in Europe and 60 Hz in the U.S.

The embodiment of my invention as described above is not the only possible embodiment thereof and many equivalent embodiments will occur to those skiled in the art to which the invention relates. For instance, step-by-step as well as continuous advance can be used; polyphase inductors may be replaced with other types of flat means creating an electrical field which submits the slabs to a field creating eddy currents. Transversal rather than longitudinal movement may be used.

I claim:

1. In apparatus for the induction heating of flat metal products, such as flat slabs or blooms, comprising a tunnel, electrical means for induction heating of said products comprising at least two flat inductor means in said tunnel, one of said inductor means being located below the other to provide a path for travel of said products between said inductor means, and means for conveying said products through said path of travel in a flat horizontal position, the improvement wherein:

said means for conveying said products comprises supporting and advancing means projecting upward through said one inductor means, for contacting the underside of each of said products at spaced locations along said tunnel to support said products in a flat horizontal position and to advance them along said tunnel, and driving means located below said one inductor means for mounting and driving said supporting and advancing means to advance said products along said path.

2. Apparatus according to claim 1, wherein said inductor means are polyphase inductors creating a travelling field moving in the longitudinal direction of the tunnel.

3. Apparatus according to claim 1, wherein said other inductor means placed above the path of travel of the product is adjustable in height while said one inductor means located under said path is fixed in position.

4. Apparatus according to claim 1, wherein the supporting and advancing means comprise a pilgrim step conveyor having feet supporting the products and passing through said one inductor means located under the path of travel of the products.

5. Apparatus according to claim 4, wherein the feet are connected to said driving means.

6. Apparatus according to claim 4, wherein the feet are at least partially of non magnetic refractory material.

7. Apparatus according to claim 1, wherein the supporting and advancing means are disks projecting through said one inductor means located below the path of travel of the products, said disks being carried by drive shafts placed below the tunnel and extending transversely to said path.

8. Apparatus according to claim 1, wherein the supporting and advancing means are disposed in two parallel rows, symmetrical with respect to the median plane of the tunnel, and have a spacing which is smaller in the zones where the products are at the highest temperature.

9. Apparatus according to claim 1, having several successive sections provided with separate temperature regulating means controlling the power dissipated in the inductor means in the successive sections.

10. Apparatus for induction heating of flat slabs and the like, comprising support means adapted to receive and support each of said slabs on a larger surface thereof and to advance it along a rectilinear direction; first polyphase electrical inductors located above the path of said slabs; and second polyphase electrical inductors located under the path of said slabs, said first and second polyphase electrical inductors being arranged to create a travelling field and so located as to leave free access to the path in the direction transverse to the direction of movement impressed on the slabs by the support means and said support means being located at locations spaced along said path; said support means comprising contacting means extending upwardly between said second inductors to contact the undersurfaces of said slabs at positions spaced apart along the direction of advance of said slabs, and driving means located below said second inductors for mounting said contacting means and for moving said slabs along said direction.

* * * * *